United States Patent [19]

Uchida et al.

[11] 4,113,523

[45] Sep. 12, 1978

[54] PROCESS OF MAKING HIGH TENSION COLD-REDUCED AL-KILLED STEEL EXCELLENT IN ACCELERATED AGING PROPERTY

[75] Inventors: Kuniki Uchida; Kenzi Araki; Hirosi Narita; Shiro Fukunaka; Takao Kurihara, all of Yokohama, Japan

[73] Assignee: Nippon Kokan Kabushiki Kaisha, Tokyo, Japan

[21] Appl. No.: 776,288

[22] Filed: Mar. 10, 1977

Related U.S. Application Data

[63] Continuation of Ser. No. 491,375, Jul. 23, 1974, abandoned.

[30] Foreign Application Priority Data

Jul. 25, 1973 [JP] Japan ..... 48/83045

[51] Int. Cl.[2] ..... C21D 7/02; C21D 7/13; C21D 7/14

[52] U.S. Cl. ..... 148/12.3; 148/12.4

[58] Field of Search ..... 148/2, 3, 12 R, 12 C, 148/12 F, 12.3, 12.4

[56] References Cited

U.S. PATENT DOCUMENTS

| | | | |
|---|---|---|---|
| 3,798,076 | 3/1974 | Shimizu et al. | 148/12 |
| 3,839,095 | 10/1974 | Kubotera et al. | 148/12 C |
| 3,865,645 | 2/1975 | Takahashi et al. | 148/2 |
| 3,904,446 | 9/1975 | Uchida et al. | 148/12 F |
| 3,936,324 | 2/1976 | Uchida et al. | 148/12 F |

*Primary Examiner*—W. Stallard

*Attorney, Agent, or Firm*—Moonray Kojima

[57] ABSTRACT

A high tension Al-killed steel of which the yield point is more increased by the ensuing heat treatment after press-forming than that of the properties in which the tensile strength is above 40 to 80 Kg/mm$^2$, is made by the following main steps:

1. the chemical composition of steel is substantially controlled at the range of 0.04 to 0.12% C, 0.10 to 1.60% Mn, and 0.010 to 0.200% Sol.Al,
2. the above steel is hot-rolled with a finishing temperature of more than 800° C and a coiling temperature of less than 630° C,
3. after the above steel strip cold-reduced with the ordinary requirements is continuously heated up to 700° to 900° C and then rapidly cooled by a jet of water, said strip is reheated up to 150° to 400° C and held for 2 to 300 seconds at said temperature to partially remain solution carbon in steel.

1 Claim, 1 Drawing Figure

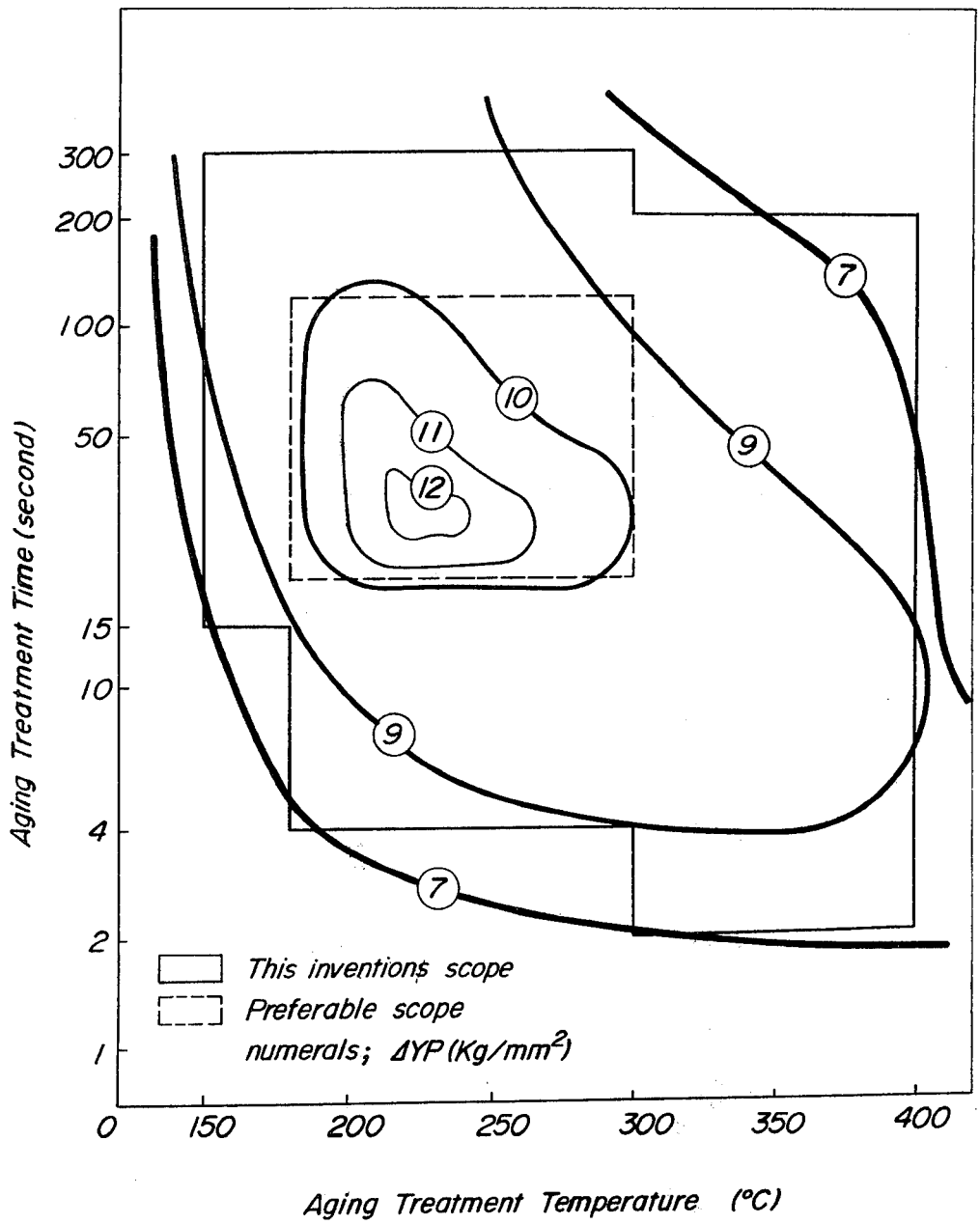
300
200
100
50
15
10
4
2
1
0
150
200
250
300
350
400
Aging Treatment Time (second)
Aging Treatment Temperature (°C)
7
9
10
11
12
This inventions scope
Preferable scope
numerals; ΔYP (Kg/mm²)

PROCESS OF MAKING HIGH TENSION COLD-REDUCED AL-KILLED STEEL EXCELLENT IN ACCELERATED AGING PROPERTY

This is a continuation of application Ser. No. 491,375, filed July 23, 1974 and now abandoned.

The present invention relates to a process of making an inexpensive high tension cold-reduced steel, and more in particular a process of offering cold-reduced steel excellent in accelerated aging properties wherein remarkable improvement in strength is seen by maintaining the tensile strength of 40 to 80 Kg/mm$^2$ and particularly, more increasing its yield point by the coming heat treatment after press forming in actual use.

Heretofore, it was well known in the art that the development of cold-reduced steel had been oriented toward a so-called soft steel having low yield point. In the process of pursuing safety in vehicles, however, particularly in passenger cars, the recent demand is oriented toward the cold reduced steel with high tensile strength. Various many proposals have been made and put to practice with this point in mind, and they may roughly be classified into the followings:

1. That which performs a complete recrystallization by using special elements as Ti, Nb, Cu, Ni, etc.
2. That which controls the annealing requirements and partially remains the cold working structure.
3. That which re-cold-reduces the steel having completed recrystallization and tries to increase strength by work hardening.
4. That which aims at improving strength by quenching the low carbon steel.

It is true that these processes are defective in one way or the other. For instance, the process (1) is defective in its high cost, while the process (2) causes dispersions in the longitudinal direction as the differences in the annealing temperature occur in the inner and the outer peripheries of the coil. The process (3) does improve the strength, but its elongation is not improved proportionately, thus leaving a problem unsolved. On the other hand, the process (4) is suitable for obtaining inexpensive high tension cold-reduced steel and various proposals have been made recently in succession on said process, namely in Japanese Patent Publications, Nos. 40-3020, 46-9541 and 46-9542.

The art disclosed in Publn. 40-3020 is well known as a BISRA process (in England). The art heats up the cold-reduced strip to 740° to 850° C, quenches the strip down to 150° to 250° C, coils the same and then performs an overaging treatment through self-annealing of said coil. The steel manufactured by said process has no accelerated aging property, i.e. AA property, caused by the heat treatment such as baking the coat after press forming, which causes an excessive lowering of the strength. Accordingly, it becomes necessary to further increase C content if the strength was to be enhanced. At the same time, the continuous process is interrupted by the above mentioned self-annealing, consequently lowers the productivity.

Those arts disclosed in Publn. No. 46-9541 and 46-9542 are called as the INLAND process (in America). The former heats up the coil consisting of fine cementite or grannular cementite and ferrite to more than $A_3$ point in order to make perfect sustenite structure not containing terminated pearlite, and then quenching uniformly to obtain a structure substantially consisting of only martensite. The latter heats up the coil to from $A_1$ to $A_3$ point to obtain partial austenitization, and then uniformly quenches the same to obtain the mixed structure of ferrite and martensite. The steel made by these processes are defective in that their strength is lowered by about 15 Kg/mm$^2$ by the coating and its baking after press forming, and that it has a poor ductility compared to its strength. This means that the steel is very difficult to handle since it is hard when being subjected to press forming and then it becomes soft when finished.

On the contrary, the steel excellent in the above AA property, which said strength is more improved by the heat treatment after press forming, were proposed by the INLAND Steel Corporation. ("Blast Furnace and Steel Plant", March 1971. pp. 149 to 153). The art adds about 100 ppm nitrogen specially at the time of the initial steel-making stage. Such a steel is cold-reduced by the ordinary method, annealed by batch type annealing and then shipped. The users are expected to perform suitable press forming and a heat treatment to improve the strength. Such an improvement in strength is attributable to the aging of said nitrogen as above discussed, but it is true that such an effect is unfortunately limited automatically so that the initial strength is as low as 40 to 50 Kg/mm$^2$ in respect of its tensile strength while said AA effect is also as low as 5 to 6 Kg/mm$^2$, thus imposing limitations in the applicable field of use. It may be said, therefore, that there is not making process available today in the art which would obtain stable AA effect at the yield point of about 9 Kg/mm$^2$ at the baking stage after press. forming.

The present inventors have suceeded in the development of high tension cold-reduced steel having extremely high AA properties obtained by the completely continuous annealing process which is different from the BISRA Process or the INLAND Process and proposed the results in the Japanese Patent Application No. 48-77865. This art concerns the steel substantially consisting of 0.04 to 0.12% C and 0.10 to 1.60% Mn and has the more increased strength by about 9.0 Kg/mm$^2$ at the yield point than that of the initial at the coating and the baking stage treatments after press forming. In this art, the cold-reduced steel strip is subjected to full continuous annealing process. Heating and soaking in this art is selected from among the range of 700° to 900° C at which the solution treating of cold-reduced steel is acheived, and the steel is rapidly quenched by the jet stream of water from the above temperature to the room temperature, than said steel, to the reheating to 150° to 400° C and is given the aging treatment at the said latter temperature. This aging treatment is not for completing the precipitation of C in steel, but for causing partial remaining solution Carbon therein. The steel is then cooled down to the room temperature and then coiled. The present invention was centrived further improving the above-mentioned at and is characterized in that said steel contains 0.01 to 0.20% Sol.Al. besides the above mentioned elements. This further improves strength of steel as well as its workability and at the same time it is possible to obtain a steel having retarded aging property and exercizing self-restraint against the raising of the yield point caused by natural aging.

Thus, an object of this invention is to provide a making process of high tension steel sheet serving to show safety of vehicles by improving of accelerated aging property of said steel and the steel, showing retarded aging property at normal condition.

Another object of this invention is to provide an inexpensive making process by a continuous annealing furnace of a high tension steel sheet excellent in accelerated aging property without addition of any special element.

Other objects and advantages will be apparent from the following description and with the accompanied drawing in which:

The FIGURE is a graph showing the changing manners of accelerated aging property dependent to the re-heating requirements of travelling strip.

The steel to which the present invention may be applied consists of substantially 0.04 to 0.12% C, 0.10 to 1.60% Mn, and 0.01 to 0.20% Sol.Al. There is no need for addition of special elements. Any types of steel making furnace in this invention known in the art today may be used and any preferred processes after steel making may be employed including ingot making — slabbing, continuous casting, etc. After scarfing the slab is heated up to about 1.250° C or more, and is hot rolled at the finishing temperature of 800° C or more and the coiling temperature of 630° C or less. Ordinary cold reducing process may be employed after pickling. The annealing in the ensuing step is a full continuous annealing process. In this case, said strip is heated up to 700° to 900° C with a rate of 200° C/min. and is maintained for 10 to 120 seconds at said temperature. The heating temperature is preferably $A_1$ to 850° C and should be controlled rigorously since it will affect the strength of the final product very much.

C in steel is thus made into solution and, at the same time fine AlN is precipitated in the above mentioned heating and soaking process. The following quenching from said temperature should be performed as rapidly as possible. Therefore the using of jet stream of water is recommended since C in steel will leave as solution carbon mentioned above. The travelling strip thus quenched down to the room temperature is reheated up to 150° to 400° C, and more preferably to 180° to 300° C and is to be maintained for some suitable length of time. The optimum time of maintaining the strip depends on the reheating temperature, and more in particular the reheating temperature selected from among the range of 150° to 180° C will take 15 seconds to 300 seconds: 180° to 300° C, 4 sec. to 300 sec. or more preferably 20 to 120 sec.: and 300 to 400° C, 2 to 200 sec. This type of low temperature aging treatment will not cause the above mentioned solution carbon in steel to precipitate completely but to remain in solution state partially. The travelling strip is then forcibly cooled down to the room temperature, coiled and tempered. The steel sheets thus obtained will easily have the following properties.

Tensile strength: 45 to 80 Kg/mm$^2$

Yield strength: 30 to 65 Kg/mm$^2$

Tensile strength (Kg/mm$^2$) + elongation(%): more than 73

The value of TS (Kg/mm$^2$) + El (%) is used as an index to evaluate the balance between the two since the increased strength usually lowers the elongation which represents ductility. The present invention steel thus treated will bring a remarkable improvement in the strength, particularly in the yield point of at least 7 Kg/mm$^2$ to 12 Kg/mm$^2$ when given the heat treatment of 100° to 200° C, i.e. baking following coating after being pressed and formed into a shape intended. This naturally is attributable to the aging effects of the solution carbon partially left by the above mentioned low temperature aging treatment. In other words, shaping is easily performed at the time of press forming because of the comparatively low yield point, consequently the excellent pressed shape of goods is freezed up as it is, and the above mentioned aging effect based on said solution carbon becomes apparent in the baking process for said goods because of the heat used ordinarily performed to the goods thus shaped. This is none other but the object of the present invention, and the safety achieved when such a steel is used for passenger cars and the like, and has no rival.

The present invention process is further elaborated in respect of its respective steps.

C in steel is an element which plays an important part in the present invention. Its lower limit is set at 0.04% in view of the stable operation of the converter used in most steel making stage and of the need to maintain required strength for steel. The upper limit was set at 0.12% in view of the press-formability and weldability. But more concretely, the upper limit should be selected from within the above range depending upon the levels of the required strength of steel. The lower limit of Mn content is set at 0.10% because of the red shortness. The upper limit thereof was set at 1.60% in view of the stable operations for the ingot making. Actually, Mn content is selected from within the range of 0.10 to 1.60% as is the case for determination of C content.

No undesirable effects are seen if Si and Al are contained by 0.2% and 0.02% or less respectively in view of the deoxidation control. No specific limit is placed on P or S and they may be contained at an ordinary level.

Sol.Al is contained with a view to improve the strength through fine grain effects and its lower limit is set at an amount which is required to stably precipitate fine AlN at the time of heating cold rolled strip, namely 0.01%. The upper limit was set at 0.20% because any amount exceeding this limit will cause checking-up of nozzles with $Al_2O_3$ at the time of ingot making and surface defects of steel. Si may be contained up to 0.2% or thereabout for deoxidation control and P and S may be contained at normal levels and there is no limit imposed on them.

The hot rolling requirements for obtaining a uniform hot rolled structure should be such that the finishing temperature is more than 800° C and preferably 830° C or more. The coiling temperature should be 630° C at most, because Al and N is steel should be left in solution state at least partially. If they were to be precipitated completely as AlN, then restrictive effects gain growth by heating in the following process cannot be expected. Such coiling operation should be performed with the utmost care and control. Pickling and cold rolling after the hot rolling may be performed in accordance with the ordinary procedures and there are no particular problems.

The present invention process is not remarkably characterised in its annealing process. The said annealing process is performed in a full continuous line starting with paying-off of the cold reduced coil and finishing with coiling of annealed strip.

The heating requirements should be such that the travelling strip must be heated up to a temperature where a great amount of solution carbon is formed in order to obtain the required strength since the hardening mechanism of the present invention steel depends greatly on the hardening based on fine precipitation of solution carbon in steel and the effect of fine grain based on fine precipitation of AlN in steel. That is to say, the heating temperature should be at least 700° C or more and more than $A_1$ point practically. On the other hand, the raising of said heating temperature in this way will increase quenching structure of martensite system thus increasing the strength of steel. However, this at the same time causes lowering of elongation since the differences of hardness between the ferrite matrix and the quenching structure as the second phase particles becomes bigger. That is why there should be an upper limit imposed on the heating temperature such as 900° C at most and 850° C industrial-wise. In this step, Al and N which have been in solution state at least partially in the coiling of hot rolling stage are precipitated as AlN. However, such precipitation should not accompany the grain growth. Accordingly, rapid heating of at least 200° C/min. is required which is different from the ordinary heating for common Al-killed steel. Such a rapid heating will, along with the holding time upon which reference shall be made later, facilitate precipptation of fine AlN and will bring about the effect of fine grain by the retraining of grain growth.

The minimum period of time for holding the travelling strip at the said heating temperature should be such that it will be sufficient for the cold rolled strip to complete recrystallization and for C in steel to become solution state, at the same time, for the above Al and N to precipitate as AlN. That is the reason for the lower limit of 10 seconds. However, the longer the holding time becomes, the more the softening caused by the grain grown after recrystallization and by the loss of said restraint effect of grain growth based on coalescence of said fine AlN, occurs which at the same time requires extending of heating-soaking zone in the continuous treating line and lowering of the line speed. Thus the upper limit is placed at 120 seconds or less.

The travelling strip thus heated and soaked is quenched down to the room temperature by a jet stream of water. In this case, the jetting of water is used to speed up said cooling and display its full cooling effect irrespective of place, i.e. "in the air" or "under water". That is to say, when the travelling strip heated is quenched into water, there is instantaneously produced a boiling steam film on surface of said strip which damages the thermal conductivity and slows down the cooling speed excessively. The jet stream of water in this invention is the most useful in eliminating such a steam film and the inventors have proven through experiments that a high speed cooling rate of more than 3,000° C/sec. is easily obtained. On the other hand, it is confirmed that a cooling rate obtained by mere still water, oil, salt bath or metal bath is only less than 1,000° C/sec. The reason for adopting such a high speed cooling rate in the present invention is because the solution carbon obtained through the process of heating and soaking is to held there at room temperature. The quenching to the room temperature as above mentioned had determinative influences low temperature aging treatment which is next step.

In reheating of the low temperature aging treatment stage, the precipitation nucleus for fine carbide of the solution carbon in steel is first formed. Fine carbide thus formed in quite useful for improving the strength, but will act to restrain the lowering of strength caused by said solution carbon to minimum. This is the first reason why the strip must be quenched down to the room temperature. The second reason is that if the steel was left as it was after being quenched to the room temperature, the strength at this stage based on the solution hardening of C is extremely high. However, it is unavoidable that the above mentioned solution carbon is precipitated and invites the lowering of strength due to coating-baking treatment ordinarily performed after press forming (usually for 10 to 20 minutes at 100 to 200° C). In other words, it becomes most difficult to handle the steel since the strength is high at the time that it is subjected to press-forming and becomes lower after press-forming. For this very reason, a low temperature aging treatment is performed by reheating the travelling strip that has been quenched down to the room temperature. In this stage, said solution carbon should be precipitated to a degree so as not to cause lowering of said strength at the time of coating-baking for formed goods. More concretely, the requirements for heating, soaking and cooling thereafter should be optimumly provided for so that not all the solution carbon is precipitated by reheating, but some remain as those are solution state.

In the above mentioned low temperature aging treatment, a good product excellent in AA property is obtained when the reheating temperature is low since tensile strength will become higher and yield strength lower as well as good shapability at the press forming stage. However, if the temperature is too low, there will occur no precipitation of solution carbon and the lowering of strength becomes unavoidable since said solution carbon get precipitated by the heat treatment at the coating-baking stage. Accordingly, the minimum reheating temperature is made at the temperature where the solution carbon get precipitated in part. The lower limit of such a temperature is 150° C. Concretely speaking, the temperature for treatment calls for above 180° C for obtaining stable results in view of the baking temperature after press forming.

On the other hand, too high a reheating temperature will soften a part of ferrite in the two phases structure wherein ferrite matrix and quenched structure coexist, thus causing inevitable lowering of steel strength. In addition, the differences in hardness between ferrite and quenched structure becomes too remarkable so that there occurs no recovery of elongation in spite of the lowered tensile strength and the said "tensile strength + elongation" index becomes lower. High reheating temperature will also cause supersaturated solution carbon to precipitate in whole at said aging treatment stage so that no AA effects can be anticipated. Accordingly, the upper limit of the reheating temperature is set at 400° C. There is no advantages obtained at the temperature exceeding 400° C. For practical purposes, the most preferable temperature is set at 180° to 300° C. The optimum range of the holding time for such reheating temperatures varies depending upon said temperature. If the said reheating temperature is set within the range of 150° to 180° C, the time should preferably be 15 to 300 seconds; if within 180° to 300° C, 4 to 300 seconds; if 300° to 400° C, 2 to 200 seconds respectively. If the said low temperature aging treatment is performed with such temperature × time requirements, then all the problems that have been discussed heretofore will be dissolved, and it becomes easily feasible to cause some part of the solution carbon remain in this stage. By such a process, the lowering of "tensile strength × elongation" index caused by the increased differences in hardness of the said two phase structure is possible to be avoided and sufficient AA effects are expected. In actual practice, when a holding time for 20 to 120 seconds as against a reheating temperature of 180° to 300° C is selected, the maximum AA properties, e.g. ΔYP is possible to be secured, while is recommended as the most suitable range. The graph in the accompanying drawing shows the fluctuation at this stage. It is seen at said graph that AA properties (in this case YP Kg/mm²) of at least 7 Kg/mm hu 2 are stably obtained when the temperature X time is selected from within the above range. It is possible to easily obtain the value of ΔYP of 12 Kg/mm² with optimum conditions. In the said graph, ΔYP shows the increasing value in yield point of the steels which have been subjected to the coating-baking process after press forming as versus those being just before said press forming.

There are no special restrictions imposed on the cooling requirements after the above mentioned low temperature aging treatment has been performed. However, if forced air cooling was to be employed because of the practical reasons, it is quite easy to cool the strip down to a temperature suitable for tempering in case that the temper rolling mill was connected integrally following the cooling step to the continuous line. The strip is coiled off after temper rolling and is shipped out of the plant. If the said temper rolling mill were not to be attached, a normal line of coiling the strip and then temperrolling the same is employed.

The following table shows the comparisons of the properties of this invention steels and those of other type steels.

(o The invention steels)

| Steels | Composition (%) C | Mn | SolA1 | Coiling temperature (° C) | Object | Heat treating requirements Heating | Quenching | Reheating | Baking |
|---|---|---|---|---|---|---|---|---|---|
| 1 | 0.07 | 0.37 | tr | 600° C | Influence of composition | 800° C×1min | In jet of water | 250° C×1min | 180° C×30min |
| o 2 | 0.07 | 0.35 | 0.053 | 540° C | | " | " | " | " |
| o 3 | 0.06 | 1.02 | 0.068 | " | | " | " | " | " |
| o 4 | 0.07 | 1.51 | 0.031 | " | | " | " | " | " |
| o 5 | 0.10 | 0.56 | 0.059 | " | | " | " | " | " |
| 6 | 0.15 | 0.49 | 0.042 | " | | " | " | " | " |
| 7 | 0.07 | 0.35 | 0.053 | 700° C | Influence of coiling temperature | " | " | " | " |
| o 8 | " | " | " | 540° C | | " | " | " | " |
| o 9 | " | " | " | " | Influence of rapid cooling requirements | " | " | " | " |
| 10 | " | " | " | " | | " | In still water | " | " |
| 11 | " | " | " | " | | " | In lead bath | 250° C×1hr | " |
| 12 | " | " | " | " | Influence of max. heating temperature | 690° C×1min | In jet of water | 250° C×1min | " |
| o13 | " | " | " | " | | 750° C×1min | " | " | " |
| o14 | " | " | " | " | | 800° C×1min | " | " | " |
| 15 | " | " | " | " | | 920° C×1min | " | " | " |
| 16 | " | " | " | " | Influence of reheating temperature | 800° C×1min | " | Non | " |
| 17 | " | " | " | " | | " | " | 100° C×1min | " |
| o18 | " | " | " | " | | " | " | 250° C×1min | " |
| o19 | " | " | " | " | | " | " | 320° C×1min | " |
| 20 | " | " | " | " | | " | " | 500° C×1min | " |
| o21 | " | " | " | " | Influence of reheating time | " | " | 250° C×10sec | " |
| o22 | " | " | " | " | | " | " | 250° ×1min | " |
| o23 | " | " | " | " | | " | " | 250° C×4min | " |
| 24 | " | " | " | " | | " | " | 250° C×10min | " |

| After rapid cooling T.S. (Kg/mm²) | Y.P.(Kg/mm²) | After reheating (1% skin pass) T.S(Kg/mm²) | El(%) | T.S.+El | After baking Y.P (Kg/mm²) | T.S (Kg/mm²) | AA effects ΔY.P | ΔT.S |
|---|---|---|---|---|---|---|---|---|
| 67.5 | 34.7 | 43.2 | 31.8 | 75.0 | 44.3 | 44.5 | 9.6 | 1.3 |
| 69.6 | 38.2 | 50.4 | 29.5 | 79.9 | 48.3 | 51.0 | 10.1 | 0.6 |
| 76.8 | 53.2 | 68.3 | 20.5 | 88.8 | 64.5 | 69.2 | 11.3 | 0.9 |
| 77.4 | 54.5 | 72.0 | 18.5 | 90.5 | 66.3 | 72.5 | 11.8 | 0.5 |
| 90.2 | 42.3 | 56.9 | 23.1 | 80.0 | 52.3 | 57.3 | 10.0 | 0.4 |
| 104.6 | 52.5 | 65.8 | 11.1 | 76.9 | 62.8 | 66.0 | 10.3 | 0.2 |
| 65.2 | 32.3 | 41.5 | 33.0 | 74.5 | 41.0 | 42.0 | 8.7 | 0.5 |
| 69.6 | 38.2 | 50.4 | 29.5 | 79.9 | 48.3 | 51.0 | 10.1 | −0.4 |
| 69.6 | 38.2 | 50.4 | 29.5 | 79.9 | 48.3 | 51.0 | 10.1 | 0.6 |
| 57.2 | 36.1 | 44.6 | 30.0 | 74.6 | 40.1 | 45.1 | 4.0 | 0.5 |
| 50.3 | 32.0 | 41.0 | 35.2 | 76.2 | 32.3 | 41.3 | 0.3 | 0.3 |
| 56.2 | 32.6 | 41.3 | 31.0 | 72.3 | 39.6 | 42.5 | 6.0 | 1.2 |
| 64.3 | 37.1 | 47.2 | 31.3 | 78.5 | 47.1 | 48.9 | 10.0 | 1.7 |
| 69.3 | 37.5 | 50.4 | 29.5 | 79.9 | 48.2 | 51.3 | 10.7 | 0.9 |
| 69.0 | 38.2 | 48.1 | 25.0 | 73.1 | 48.0 | 49.0 | 9.8 | 0.9 |
| 69.3 | — | — | — | — | — | 52.5 | — | −16.8* |
| " | 39.2 | 63.3 | 23.9 | 77.2 | 49.6 | 52.5 | 10.4 | −10.8 |
| " | 38.3 | 50.4 | 29.5 | 79.9 | 48.3 | 51.0 | 10.0 | −0.4 |
| " | 35.0 | 46.2 | 31.6 | 77.8 | 42.5 | 46.3 | 7.5 | 0.1 |
| " | 31.2 | 40.3 | 33.5 | 73.8 | 31.9 | 40.3 | 0.7 | 0 |
| " | 38.8 | 53.2 | 28.9 | 80.1 | 49.0 | 51.0 | 10.2 | −2.2 |
| " | 38.2 | 50.4 | 29.5 | 79.9 | 48.3 | 51.0 | 10.1 | 0.6 |
| " | 37.5 | 50.5 | 29.5 | 80.0 | 45.9 | 50.9 | 8.4 | 0.4 |
| " | 34.5 | 46.2 | 32.0 | 78.2 | 37.5 | 46.3 | 3.0 | 0.1 |

Notes:

The requirements of manufacture other than those listed above are the same for all the steels and are as follows.

1. Heating rate in heat treating requirements: 800° C/min
2. Baking requirements after press forming are the same as those generally used in automobile manufacturing companies: 180° C×30min
3. Making requirements except coiling temperature (hot rolling) Finishing temperature: 850° C (hot rolling) Finishing thickness: 2.8mm (hot rolling) Cold reducing thickness: 1.2mm
4. *Lowering value/between that of after rapid cooling of strength and of after baking In the above table, the steels 1 to 6 were investigated in respect of the influences of the compositions and the steel 1 contains no Sol.Al, the steel 6 contains more C than that of the present invention steel and the steels 2 to 5 are the present invention steels. There are no great differences in AA effects in the case of the steels 1 and 2. Howver, it is seen that the level of strength of the steel 2 to which Al addition has been made is about 7 $Kg/mm^2$ higher than that of the steel 1. This is caused by the effect of fine grains based on aluminium addition and by improving of workability. Of these Al-killed steels, the steels 3 and 4 particularly have a greater amount of Mn content, and the level in strength is raised greatly as the amount of Mn is increased, however the lowering of elongation as compared to the improved strength is small, with higher "Ts + El" index and high ΔYP value of about 11 $Kg/mm^2$. Thus, this is indeed an excellent steel. When comparing the steels 2, 5 and 6, the influence of C content will become known. According to this, the increased C content will increase the level of the strength. However, if C is bigger than 0.12% as in the case of the steel 6, elongation will become excessively inferior and there is presented a problem in workability. Moreover, the part of martensite system within the structure will be increased which is tempered at the time of welding, causing lowered strength. Whereas in the case of the steel 5 ($C=0.10\%$), there are no problems in both workability and weldability and it is known that the upper limit of C content should be set at 0.12%.

The steels 7 and 8 were investigated in respect of the influences of the coiling temperature at the hot rolling stage. When the coiling is performed at a high temperature (700° C) as in the case of the steel 7, AlN becomes completely precipitated at the time of hot rolling and there is no effect of fine grains at the time of solution treatment, and it is learnt that the strength is lowered when compared to that of steel 8. Accordingly, it is necessary for the present invention steels to set the coiling temperature at below 630° C in hot rolling in order that some part of Al and N become solution state.

The steels 9 to 11 were studied in respect of the influences of rapid quenching requirements, and it is found that the steel 10 which has been quenched in still water has lower strength and smaller AA effects as compared to the steel 9 which has been quenched in the jet stream of water. The steel 11 was quenched in the lead bath of 250° C as in the BISRA process, and shows lower strength compared to that of the steel 9 and absolutely no AA effects. Thus, it will become known that quenching in the jet stream of water is the most significant requirement in the present invention art in view of the improving of strength and AA effects.

The steels 12 to 15 were investigated in respect of the influences of the maximum heating temperatures. If the maximum heating temperature is as low as for the steel 12, solution C is impossible and to be obtained sufficiently and thus the strength is lower and AA effects are smaller. If the heating temperature is high as for the steel 15, the effect of fine grains disappers owing to coalescence of AlN therby so that it has lower strength than the steel 14. The occupying rate of martensite in steel becomes bigger and the difference in hardness of this as compared to that of ferrite matrix brings about the elongation greatly so that "TS + El" index in the final analysis becomes smaller proving various disadvantages of this steel. It is known that there are upper and lower limits imposed on the maximum heating temperatures and the present invention steels 13 and 14 show excellent strength, AA effects and properties.

The steels 16 to 20 show the influences of the reheating temperatures. For the steel 16 which has not been subjected to any reheating, the high strength after quenching is seen to have become greatly lower, showing difficulties of this steel in handling particularly in view of the high level is strength at the time of press forming. The steel 17 which is subjected to a low temperature reheating will invite the lower strength of after baking than that after reheating, thus cancelling the effect of reheating completely. The steels 18 and 19 show high level in strength and good AA effects displaying excellent properties, but the steel 20 has lower strength and no AA effects as it is subjected to a higher reheating. Therefore; there are imposed naturally the upper and the lower limits on the reheating temperatures and the steels show excellent physical properties when the range is within 150° to 400° C.

The steels 21 to 24 were investigated in respect of the influences of the reheating time and show a tendency of the lowering of strength owing to extending of said reheating time. If it was held as for 10 minutes as in the case of the steel 24, there occurs the lowering of the strength and radical decrease in AA effects. On the other hand, the effects of reheating are evident even at 250° C × 10 seconds with somewhat decreased TS value but greatly increased YP after baking. Thus, the time of reheating should be selected from within the range of 2 to 300 seconds corresponding to the reheating temperature being employed. Thus, it becomes easily feasible to cause solution carbon to remain partially steel.

As has been explained heretofore in respect of many examples, the technical characteristics of the present invention process will become readily apparent. This aims at improving more than that of the material manufactured in accordance with the process disclosed in Japanese Patent Application No. 48-77865 which in turn improved the semi-continuous process of said BISRA method and the batch-type method of said INLAND Steel method aiming at attaining of AA effects by N content in the steel. As has been discussed, the improvement is based on the differences between (1) quenching to the coiling temperature by lead bath in said BISRA process and quenching to the room temperature in the jet stream of water in the present invention process (2) the complete precipitation of solution carbon through self annealing at the said ceiling temperature in BISRA method and partial remaining of solution carbon through reheating aging in the present invention method, and (3) the action of [N] in the INLAND Steel type batch annealing where no aging effect of C may be anticipated and the control process of solution carbon through control of AlN precipitation and full continuous annealing process in the present invention (where the N content is unavoidable in the steel making stage).

We claim:

1. Process of making a high tension cold-reducing steel sheet comprising the steps of (A) preparing steel consisting essentially of 0.04 to 0.12% carbon, 0.10 to 1.60% manganese, and 0.01 to 0.20% soluble aluminum and balance essentially of iron;

(B) hot rolling said steel at a finishing temperature of more than 800° C and a coiling temperature of less than 630° C to make Al and N partially solute in the steel;

(C) cold reducing said steel;

(D) and fully continuously annealing said steel by the sequential steps consisting essentially of (a) heating said steel to a temperature within the range of more than $A_1$ to 850° C at the heating rate of more than 200° C/min and holding said temperature for 10 to 120 seconds, (b) rapidly cooling said heated steel at a rate of more than 3,000° C/sec from said held temperature by jet stream of water to room temperature, thereby to form a dual phase structure of ferrite-martensite, (c) reheating said steel to a temperature within the range of 180° C to 300° C and holding at said temperature for 20 to 120 seconds thereby to cause part of said carbon to remain in solution in said steel as well as partially precipitate carbon, and (d) cooling and coiling thereby to impart bake hardening properties to the steel.

* * * * *